US006157307A

United States Patent [19]

Hardin

[11] Patent Number: 6,157,307

[45] Date of Patent: Dec. 5, 2000

[54] FLOODWATER DETECTION AND WARNING DEVICE

[76] Inventor: Kenneth J. Hardin, 6428 Hickory Hollow Ct., Flint, Mich. 48532

[21] Appl. No.: 09/232,340

[22] Filed: Jan. 15, 1999

Related U.S. Application Data

[60] Provisional application No. 60/078,317, Mar. 17, 1998.

[51] Int. Cl.[7] ..... G08B 21/00

[52] U.S. Cl. ..... 340/604; 340/605; 340/691.4; 340/691.5; 73/40; 73/85.5

[58] Field of Search ..... 340/604, 605, 340/691.1, 691.4, 691.5; 73/40, 40.5 R, 40.5 A, 45.5

[56] References Cited

U.S. PATENT DOCUMENTS

| | | | |
|---|---|---|---|
| 3,874,403 | 4/1975 | Fischer | 340/605 |
| 4,020,478 | 4/1977 | Hatfield | 340/604 |
| 4,126,857 | 11/1978 | Lancia et al. | 340/605 |
| 4,297,686 | 10/1981 | Tom | 340/604 |
| 4,319,232 | 3/1982 | Westphal et al. | 340/604 |
| 4,845,472 | 7/1989 | Gordon et al. | 340/604 |
| 4,973,947 | 11/1990 | Tax | 340/608 |
| 5,008,650 | 4/1991 | Hoiberg | 340/604 |
| 5,091,715 | 2/1992 | Murphy | 340/604 |
| 5,188,143 | 2/1993 | Krebs | 340/605 |
| 5,229,750 | 7/1993 | Welch, Jr. et al. | 340/605 |
| 5,240,022 | 8/1993 | Franklin | 340/605 |
| 5,428,347 | 6/1995 | Barron | 340/604 |
| 5,539,383 | 7/1996 | Chin | 340/604 |
| 5,632,302 | 5/1997 | Lenoir, Jr. | 340/604 |
| 5,655,561 | 8/1997 | Wendel et al. | 340/605 |

*Primary Examiner*—Daniel J. Wu
*Attorney, Agent, or Firm*—Young & Basile, P.C.

[57] ABSTRACT

A device for detecting and warning of floodwater about a building structure, the device including a plurality of selectable remote alarm indicators, a matching plurality of alarm selector switches for selectively enabling and disabling the remote alarm indicators, means for detecting the presence of water, a power circuit with backup battery capability, a selectable intermittent alarm signal generator, a master remote alarm enabler switch, an automatic audio alarm indicator which emits different alarm noises depending on a floodwater condition and/or a low power condition, an alarm priority override circuit, a power status light indicator, and a selectively activatable self-test circuit for simulating a floodwater condition.

20 Claims, 4 Drawing Sheets

FLOODWATER DETECTION AND WARNING DEVICE

CROSS-REFERENCE TO PRIOR APPLICATION

For the purpose of establishing priority, the subject matter previously disclosed in provisional patent application 60/078,317 as now presented in this formal patent application is entitled to the benefit of the filing date of said provisional application, said filing date being Mar. 17, 1998.

FIELD OF THE INVENTION

The present invention relates to a water detection and warning device for use in flood, overflow, or leakage conditions which often occur, for example, proximate to sinks, water heaters, washing machines, toilets, plumbing, roofs, dishwashers, bathtub and/or shower areas, air conditioning systems, or other water-related appliances, as well as in basement or crawl space areas.

BACKGROUND OF THE INVENTION

Water leakage, water overflow, and floodwater conditions about a building structure can cause significant property damage. For example, such water leakage can ruin carpets, ruin the finish on hardwood floors, cause wallpaper and/or paint on walls to peel, ruin the upholstery and/or finish on fine furniture, short-circuit and thereby ruin expensive electrical appliances, ruin valuable antiques and/or artwork, contaminate food and/or water supplies, and even compromise the structural integrity of a building structure. The prospect of such damage dictates the need for a device that effectively detects the presence of undesired leakage water and immediately thereafter alerts someone who is about the building structure so that the condition can be quickly and appropriately remedied.

Given that water leakage, water overflow, and floodwater conditions are prone to occur, for example, proximate to sinks, water heaters, washing machines, toilets, plumbing, roofs, dishwashers, bathtub and/or shower areas, air conditioning systems, or other water-related appliances, as well as in basement or crawl space areas, a water detection and warning device should therefore be compatible with and installable in any of such areas. Furthermore, given that most building structures have multiple chambers and/or floor levels, the proposed water detection and warning device should also include an alarm indicator system that can be flexibly located and positioned to effectively alert one or more persons in various building chambers and/or on various floors that are both local and remote with respect to the particular building chamber and/or floor where the water is detected. In this way, for example, if the water detection system of the proposed device detects water in a chamber that is less frequented by persons than are other chambers about the building structure, then at least part of the alarm indicator system of the proposed device can be strategically placed in one or more remote chambers that are more often frequented to better ensure that a person is notified and warned of the water leakage condition.

Furthermore, any proposed water detection and warning device having such an alarm indicator system, as described hereinabove, should also ideally have the capability for selectively enabling and disabling individual portions of the alarm indicator system in the one or more various chambers and/or on the one or more various floors about the building structure. In this way, for example, a person operating the device can flexibly choose to enable only those portions of the alarm indicator system which correspond to areas about the building structure in which the operator anticipates there being a person present to appropriately respond to any alarm. In light of such capability, however, it is also desirable that such a device includes at least one automatic alarm indicator that cannot be selectively disabled and that will always be activated when leakage water is detected. Such an automatic alarm indicator ensures that at least one alarm indicator will be activated during a leakage condition, even when the operating person selectively disables all other portions of the alarm indicator system about the building structure.

Given that many building structures have at least one doorbell system and/or at least one burglar alarm system, a water detection and warning device should at least be compatible with such existing systems and should also, ideally, have the capability of being integrated with such systems. In this way, for example, the doorbell chimes in a traditional doorbell system located within a particular chamber of a building structure could serve the dual role of both functioning as a traditional doorbell and also functioning as an alarm indicator signifying a water leakage condition. Such system integration serves to conserve space within the chamber and also preserve the overall aesthetic appearance of the chamber.

In addition to the above considerations, a water detection and warning device should ideally include various types of alarm indicators to ensure successfully alerting persons who are visually or hearing impaired, as well as alerting a person who may be sleeping.

Furthermore, a water detection and warning device should ideally include a power circuit system that has backup battery capability. Such backup battery capability is ideal for ensuring proper operation of the device during power outage situations within a building structure. The device should also ideally include a power status indicator so that a person can easily discern whether the water detection and warning device has electrical power to function properly.

Lastly, a water detection and warning device should ideally include self-testing capability so that the device can be functionally tested even in the absence of an actual water leakage and/or floodwater condition. Such self-testing capability and the periodic execution of self tests together help ensure that the device will perform properly when a water leakage and/or a floodwater condition actually occurs.

At the present time, many of the water detection and warning devices which are currently available in the marketplace have addressed and incorporated to some degree one or some of the above-mentioned considerations and features in their respective designs. However, no currently available device addresses and incorporates all such considerations and features together in a single, functionally-efficient design as does the presently proposed invention set forth and described hereinbelow.

SUMMARY OF THE INVENTION

The present invention is a device for detecting and warning of floodwater and/or leakage water about a building structure. As proposed, the device basically includes a plurality of selectable alarm indicators, a plurality of alarm selector switches wherein each particular alarm selector switch is electrically connected to a particular alarm indicator, means for detecting the presence of water, and a power circuit.

Consistent with the present invention, the proposed device may ultimately include a plurality of selectable remote alarm indicators, a matching plurality of alarm selector switches for selectively enabling and disabling the remote alarm indicators, means for detecting the presence of water, a power circuit with backup battery capability, a selectable intermittent alarm signal generator, a master remote alarm enabler switch, an automatic audio alarm indicator which emits different alarm noises depending on a floodwater condition and/or a low power condition, an alarm priority override circuit, a power status light indicator, and a selectively activatable self-test circuit for simulating a floodwater condition. Consistent with the present invention, an automatic visual alarm indicator may be utilized instead of, or in combination with, the automatic audio alarm indicator. Also consistent with the present invention, an audio indicator may be utilized instead of, or in combination with, the light indicator for conveying power status information concerning the proposed device.

In such an ultimate form, the present invention generally provides an alarm indicator system that can be flexibly located and positioned to effectively alert one or more persons in various building chambers and/or on various floors that are both local and remote with respect to the particular building chamber and/or floor where the water is detected. More particularly, the present invention provides a water detection and warning device which includes a water detecting means, an automatic audio (or visual) alarm indicator, and a plurality of selectable remote alarm indicators. According to the present invention, each of the selectable remote alarm indicators, in particular, may be flexibly and electrically connected to the water detecting means such that the selectable remote alarm indicators can be independently located and positioned about a building structure. In this way, one or more persons within the various local and/or remote building chambers, and/or on the various local and/or remote floors, can be effectively alerted.

The present invention also generally provides an alarm indicator system that has the capability for selectively enabling and disabling individual portions of the alarm indicator system in the one or more various chambers and/or on the one or more various floors about a building structure. More particularly, the present invention provides a water detection and warning device that includes a plurality of selectable remote alarm indicators and a corresponding plurality of alarm selector switches. The selectable remote alarm indicators may be independently located and positioned at various different locations about a building structure to thereby form a wide-reaching alarm indicator system about the building structure. Each individual selectable remote alarm indicator can independently be either enabled or disabled by one of the alarm selector switches (as permitted by the master remote alarm enabler switch) In this way, for example, a person operating the water detection and warning device can flexibly choose to enable only those individual remote alarm indicators which positionally correspond to areas about the building structure in which the operator anticipates there being a person present to appropriately respond to any alarm situation. In addition to such capability, the device according to the present invention also includes an automatic audio (and/or visual) alarm indicator that cannot be selectively disabled and that will always be activated when water is detected. Such an automatic alarm indicator ensures that at least one alarm indicator will be activated during an actual leakage condition, even when the operating person has selectively disabled all of the selectable remote alarm indicators located about the building structure.

The present invention also generally provides a water detection and warning device that is compatible with and that can be integrated with an existing doorbell system and/or an existing burglar alarm system that may be present in a given building structure. More particularly, the present invention provides a water detection and warning device which includes alarm selector switches which, for example, may be utilized to selectively enable or disable, for the purpose of indicating a water leakage and/or floodwater condition, the chimes of an existing traditional doorbell system and/or the alarm indicator of an existing burglar alarm system that may be present in a given building structure.

The present invention also generally provides a water detection and warning device that includes various types of alarm indicators to ensure successfully alerting persons who are visually or hearing impaired, as well as alerting a person who may be sleeping. More particularly, the device according to the present invention includes an automatic audio and/or visual alarm indicator in addition to selectable remote alarm indicators which can be selectively enabled via alarm selector switches. The selectable remote alarm indicators may include audio and/or visual type alarm indicators, such as, for example, an electric buzzer, a light, a doorbell system, a burglar alarm system, or any combination thereof. Furthermore, the device further includes an intermittent alarm signal generator which can be selectively activated to thereby permit the selectable remote alarm indicators to be activated intermittently (as opposed to being activated constantly), as permitted by the alarm selector switches and the master remote alarm enabler switch when water is detected (or when a self-test operation is executed).

The present invention also generally provides a water detection and warning device that includes a power circuit system that has backup battery capability. More particularly, the device according to the present invention includes a power circuit that has a designated set of power terminals to which a DC (direct-current) battery can be connected to serve as a backup electrical power source. With such backup battery capability, proper operation of the device can be ensured, even during power outage situations within a building structure.

The present invention also generally provides a water detection and warning device that includes a power status indicator so that a person can easily discern whether the device has electrical power to function properly. More particularly, the device according to the present invention includes a light indicator for conveying device power status information to a person operating the device. As briefly alluded to above, also consistent with the present invention, an audio indicator may be utilized instead of, or in combination with, the light indicator for conveying such power status information.

Lastly, the present invention also generally provides a water detection and warning device that includes self-testing capability so that the device can be functionally tested even in the absence of an actual water leakage and/or floodwater condition. More particularly, the device according to the present invention includes a self-test circuit which is selectively activatable by a person operating the device. With such self-testing capability, a person operating the device can thereby periodically execute tests to help ensure that the device will perform properly when a water leakage and/or a floodwater condition actually occurs.

Other advantages, design considerations, and applications of the present invention will become apparent to those skilled in the art when the detailed description of the best mode contemplated for practicing the invention, as set forth hereinbelow, is read in conjunction with the accompanying drawings.

DETAILED DESCRIPTION OF THE PREFERRED EMBODIMENT

The preferred structure and operation of the water detection and warning device, according to the present invention, is set forth hereinbelow.

A. Structure of the Invention

Figure 1:
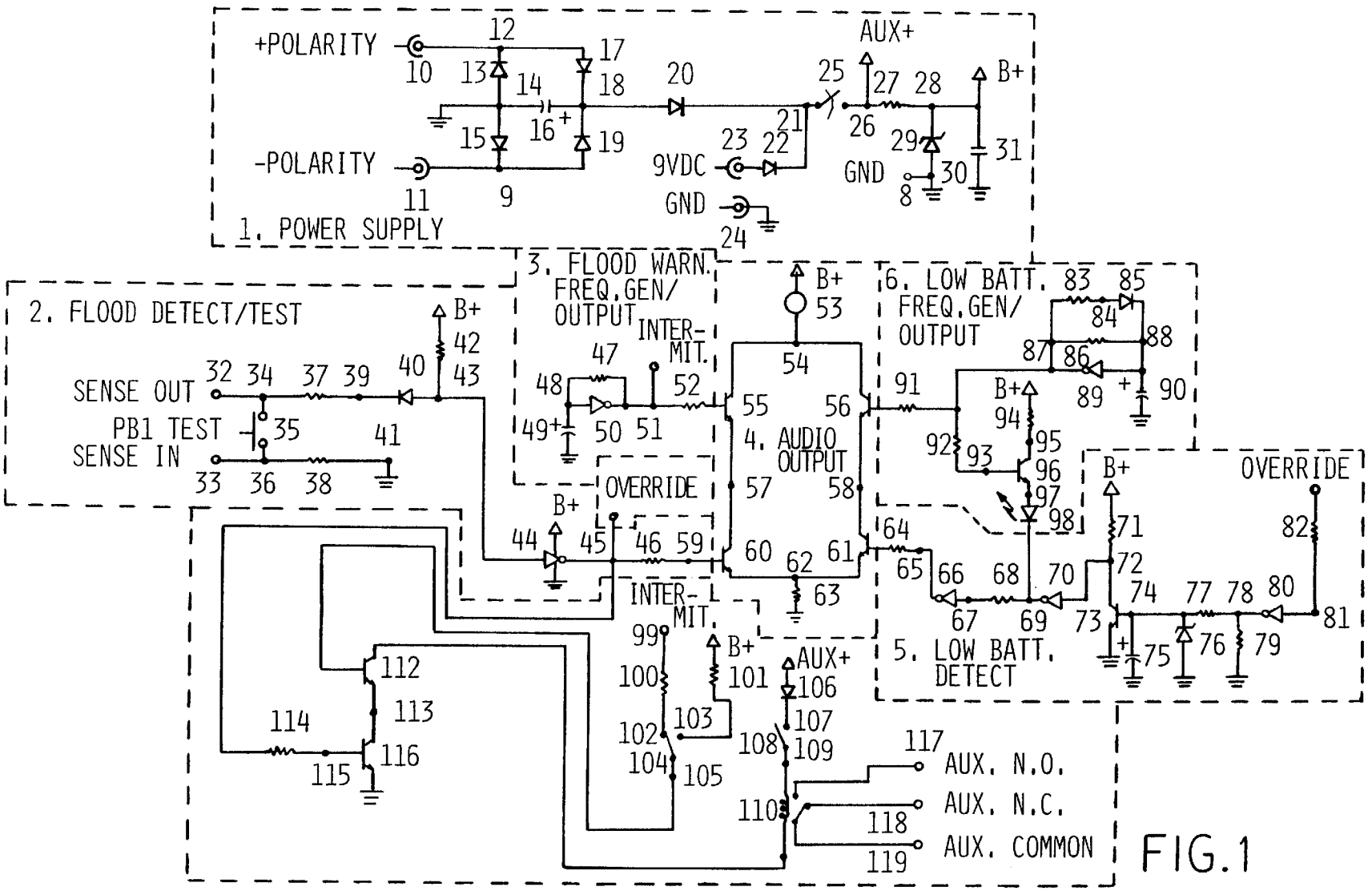
FIG. 1 is a detailed circuit diagram of the main body of electronic circuitry comprising the water detection and warning device of the present invention, therein delineating seven task-specific sub-circuits.

As shown in FIG. 1, the main body of electronic circuitry comprising the water detection and warning device, in its preferred embodiment, is primarily made up of seven functionally unique sub-circuits.

Sub-circuit 1 is a power circuit designed to supply a stable electrical power source to all sub-circuits in FIG. 1. Primary power terminals 10 and 11 provide appropriate electrical interfaces for the cathode and anode of a selected battery or other properly transformed voltage source which may be used to supply primary electrical power to sub-circuit 1. According to the preferred embodiment, a 9 to 24-volt DC (direct current) or AC (alternating current) battery or a 9 to 24-volt DC or AC source obtained via an AC voltage adapter and/or transformer is ideal. Consistent with the present invention, the sub-circuits of the present invention can be slightly modified to accommodate other power source voltage levels as well. Terminal 10 is electrically connected to circuit node 12 and terminal 11 is electrically connected to circuit node 9. Node 12 is connected to the cathode of diode 13 and the anode of diode 17, whereas the anode of diode 13 is connected to node 14. Node 14, in turn, is electrically grounded. In addition to being grounded and connected to diode 13, node 14 is also connected to the anode of diode 15. The cathode of diode 15 is electrically connected to node 9, and the anode of diode 19 is connected to node 9 as well. The cathodes of both diode 17 and diode 19 are electrically connected together at node 18, whereas capacitor 16 is connected between circuit nodes 14 and 18.

Further in sub-circuit 1, diode 20 is electrically connected between circuit nodes 18 and 21 such that the anode of diode 20 is connected to node 18 and the cathode of diode 20 is connected to node 21. Node 21, in turn, is connected to the cathode of diode 22, and the anode of diode 22 is connected to backup power terminal 23. According to the preferred embodiment of the present invention, a 9-volt DC backup battery is connected between backup power terminals 23 and 24 such that the anode of the 9-volt battery is connected to terminal 23 and the cathode of the battery is connected to terminal 24. Terminal 24 is electrically grounded so that the voltage potential at terminal 23 is +9 volts DC (VDC) with reference to electrical ground (GND). In general, power terminals 23 and 24 essentially serve as electrical interfaces for a backup battery. Consistent with the present invention, other backup batteries providing other voltage levels may be utilized as well.

A power switch 25 is connected between circuit nodes 21 and 26 such that if switch 25 is manually set to a closed position, node 21 will be electrically shorted with node 26, thereby essentially transferring the voltage potential at node 21 to node 26. Alternatively, if switch 25 is manually set to an open position, an open circuit condition between nodes 21 and 26 will result, thereby preventing the transfer of voltage potential from node 21 to node 26. When switch 25 is set to the closed position, the resulting voltage (AUX+) at node 26 is used to supply additional power to sub-circuit 7.

Still further in sub-circuit 1, resistor 27 is connected between nodes 26 and 28. In addition, node 28 is also connected to the cathode of zener diode 29 (having a preferred breakdown voltage of about 12 volts) while the anode of zener diode 29 is connected to node 30. Node 30, in turn, is connected to electrical ground (GND), that is to say that node 30 is electrically grounded. Terminal 8 is shorted to node 30 and is thereby electrically grounded as well. Furthermore, capacitor 31 is connected between node 28 and electrical ground. As a result of the above, the derived voltage (B+) at node 28 supplies power to the other sub-circuits. Preferably, the supply voltage B+ at node 28 is about 12 volts when power switch 25 is set to the closed position. In general, the combination of resistor 27 and zener diode 29 essentially serves as a voltage regulator circuit.

Sub-circuit 2 is designed to detect when a floodwater and/or water leakage condition has occurred. In particular, whenever terminals 32 and 33 (together comprising water sensor S) each contact the same pool of water, then terminals 32 and 33 are thereby shorted together and electrical current may then flow out from terminal 32, through the pool of water, and into terminal 33. In this way, sub-circuit 2 "senses" the presence of water. Furthermore, terminal 32 is connected to node 34, and terminal 33 is connected to node 36. Resistor 38 is connected between nodes 36 and 41. Node 41, in turn, is electrically grounded. A selectively activatable self-test pushbutton (PB1) 35 is connected between nodes 34 and 36 such that when pushbutton 35 is manually depressed, nodes 34 and 36 are thereby shorted together and electrical current may then flow from node 34 and into node 36, even in the absence of a floodwater and/or water leakage condition. Self-test pushbutton 35, in essence, permits a person to test the water detection and warning device by simulating a floodwater and/or water leakage condition to thereby enable the person to determine whether the device, according to the present invention, is operating properly.

Further in sub-circuit 2, resistor 37 is connected between nodes 34 and 39. Node 39 is, in turn, connected to the cathode of diode 40 while the anode of diode 40 is connected to node 43. Resistor 42 is connected between node 43 and supply voltage B+at node 28 in sub-circuit 1. In addition, node 43 is connected to the input of inverting comparator 44, whereas node 45 is connected to the output of inverting comparator 44. In essence, inverting comparator 44 is a single-gate Schmidt trigger IC (integrated circuit) of the signal-inverting type. That is, when the voltage potential at node 43 is higher than the set reference voltage of comparator 44, then the output voltage of comparator 44 at node 45 will be low. Alternatively, when the input voltage at node 43 is lower than the set reference voltage of comparator 44, the output voltage at node 45 will be high. The IC incorporating inverting comparator 44 is appropriately connected to electrical ground and powered by supply voltage B+ (derived at node 28 in sub-circuit 1). In addition, resistor 46 is connected between circuit nodes 45 and 59.

Sub-circuit 3 serves as an intermittent alarm signal generator which is designed to provide an electrical square wave output signal (that is, an intermittent high enabling signal) to sub-circuit 4 and sub-circuit 7. To accomplish this, an inverting comparator 50 (of the same type as inverting comparator 44) is connected between node 48 and node 51 such that the input to comparator 50 is connected to node 48 and the output of comparator 50 is connected to node 51. Capacitor 49 is connected between node 48 and electrical ground. Resistor 47 is connected between nodes 48 and 51 as a feedback loop for comparator 50. Resistor 52, on the other hand, is connected between node 51 and the base of NPN transistor 55 of sub-circuit 4.

Sub-circuit 4 is designed to provide an automatic audio alarm when activated by signals from sub-circuits 2 and 3 or activated by signals from sub-circuits 5 and 6. Sound element 53 (such as, for example, a Piezo electric buzzer) serves as an automatic audio alarm indicator and is connected between supply voltage B+ (derived at node 28 of sub-circuit 1) and node 54. Sound element 53 is activated when current is permitted to pass through the element 53 from supply voltage B+ to node 54. Consistent with the present invention, an automatic visual alarm indicator (for example, a light) may be utilized instead of, or in combination with, the automatic audio alarm indicator. Node 54, in turn, is connected to both the collector of NPN transistor 55 and the collector of NPN transistor 56. The emitter of transistor 55 is connected to node 57 while the emitter of transistor 56 is, in contrast, connected to node 58.

Further in sub-circuit 4, node 57 is connected to the collector of NPN transistor 60. The base of transistor 60 is connected to node 59 of sub-circuit 2 while the emitter of transistor 60 is connected to node 62. The emitter of transistor 56 is, on the other hand, connected to the collector of NPN transistor 61 via circuit node 58. In addition, the emitter of transistor 61 is connected to node 62. Resistor 63 is connected between node 62 and electrical ground.

Sub-circuit 5 is designed to detect a low power condition and thereafter send an alarm enabling signal to sub-circuit 4 when the supply voltage B+ (derived at node 28 of sub-circuit 1) drops below a certain threshold level. To accomplish this, resistor 82 is connected between node 45 of sub-circuit 2 and node 81. Node 81, in turn, is connected to the input of inverting comparator 80 (of the same type as inverting comparator 44) while the output of comparator 80 is connected to circuit node 78. Resistor 79 is connected between node 78 and electrical ground. In addition, resistor 77 is connected between nodes 78 and 74. Zener diode 76 (having a preferred breakdown voltage of about 3.6 volts) is connected between node 74 and electrical ground such that the cathode of zener diode 76 is connected to node 74 and the anode is connected to electrical ground. Also, capacitor 75 is connected between node 74 and electrical ground. Node 74, additionally, is connected to the base of PNP transistor 73.

Further in sub-circuit 5, the collector of PNP transistor 73 is connected to electrical ground, whereas the emitter of transistor 73 is connected to circuit node 72. Resistor 71 is connected between node 72 and supply voltage B+. In addition, node 72 is connected to the input of inverting comparator 70 (of the same type as comparator 44). The output of inverting comparator 70 is, in turn, connected to circuit node 69. Further, resistor 68 is connected between node 69 and node 67. Node 67, however, is connected to the input of inverting comparator 66 (of the same type as comparator 44), and the output of comparator 66 is connected to node 65. Finally, resistor 64 is connected between node 65 and the base of NPN transistor 61 in sub-circuit 4.

Sub-circuit 6 is designed to provide an electrical square wave output signal (that is, an intermittent high enabling signal) to sub-circuit 4 and to provide an intermittent voltage sampling of supply voltage B+ to sub-circuit 5 for detecting whether supply voltage B+ is problematically low. To accomplish this, inverting comparator 89 (of the same type as comparator 44) is connected between circuit node 87 and circuit node 88 such that the input of comparator 89 is connected to node 88 and the output is connected to node 87.

Capacitor 90 is connected between node 88 and electrical ground. As part of a feedback loop for comparator 89, resistor 86 is connected between nodes 87 and 88. For the remaining part of the feedback loop, resistor 83 and diode 85 are serially connected between nodes 87 and 88, in parallel with resistor 86. Resistor 83 is connected between node 87 and the anode of diode 85 via node 84. The cathode of diode 85, in turn, is connected to node 88.

Further in sub-circuit 6, resistor 91 is connected between node 87 and the base of NPN transistor 56 in sub-circuit 4. In addition, resistor 92 is connected between node 87 and the base of NPN transistor 96 via node 93. The collector of transistor 96 is connected to node 95. Resistor 94 is connected between node 95 and supply voltage B+ (node 28 of sub-circuit 1). The emitter of transistor 96, on the other hand, is connected-to the anode of light-emitting diode (LED) 98. In general, LED 98 serves as a visual light indicator to convey power status information concerning the voltage B+ which is supplied by sub-circuit 1. The cathode of LED 98 is, in turn, connected to node 69 of sub-circuit 5. Consistent with the present invention, it is to be understood that an audio indicator may be utilized instead of, or in combination with, the light indicator to convey such power status information.

Sub-circuit 7 is designed to provide a means for operating and/or signaling other external auxiliary devices (that is, external devices serving as remote alarm indicators) during a floodwater and/or water leakage condition sensed (or when self-test pushbutton 35 is pushed) in sub-circuit 2. To accomplish this, resistor 100 is connected between node 99 and node 102, whereas node 99 is shorted with node 51 of sub-circuit 3. Resistor 101 is connected between node 103 and supply voltage B+ (node 28 of sub-circuit 1). An alarm signal selector switch 104 is selectively connected among nodes 102, 103 and 105 such that switch 104 allows manual selecting between either shorting node 102 to node 105 or shorting node 103 to node 105. In this way, a person can select and direct either a continuously high signal from supply voltage B+ to node 105 or alternatively select and direct an intermittent high signal (produced by the square wave derived by the intermittent alarm signal generator in sub-circuit 3) to node 105.

Further in sub-circuit 7, voltage AUX+ (derived at node 26 in sub-circuit 1) is connected to the anode of diode 106 while the cathode of diode 106 is connected to node 107. A master remote alarm enabler switch 108 is connected between node 107 and node 109 such that switch 108 thereby permits a person to either short nodes 107 and 109 together or alternatively create an open circuit between nodes 107 and 109. In addition, the inductor coil of relay 110 is connected between nodes 109 and 111 such that when current passes through the coil of relay 110, the switch of relay 110 is "pulled in," away from node 118, so that node 117 is instead shorted with node 119 (common node). Node 117, in turn, is selectively connected to other external auxiliary devices (remote alarm indicators 130, 131, 132, and 133 shown in FIG. 2) so that such devices can be operated and/or signaled when current passes through the coil of relay 110. Alternatively, if current is not permitted to pass through the coil of relay 110, then the switch of relay 110 is not "pulled in," and node 118 (instead of node 117) is shorted with node 119. Node 118, thus, can similarly be connected to certain external auxiliary devices as well so that such devices can be operated and/or signaled when no current is passing through the coil of relay 110.

Further in sub-circuit 7, node 111 is connected to the collector of NPN transistor 112 while the emitter of transistor 112 is connected to node 113. The base of transistor 112 is connected to node 105. Node 113, in turn, is connected to the collector of NPN transistor 116, whereas the emitter of transistor 116 is connected to electrical ground. The base of transistor 116 is connected to circuit node 115. Resistor 114 is connected between node 115 and node 45 of sub-circuit 2.

Figure 2:
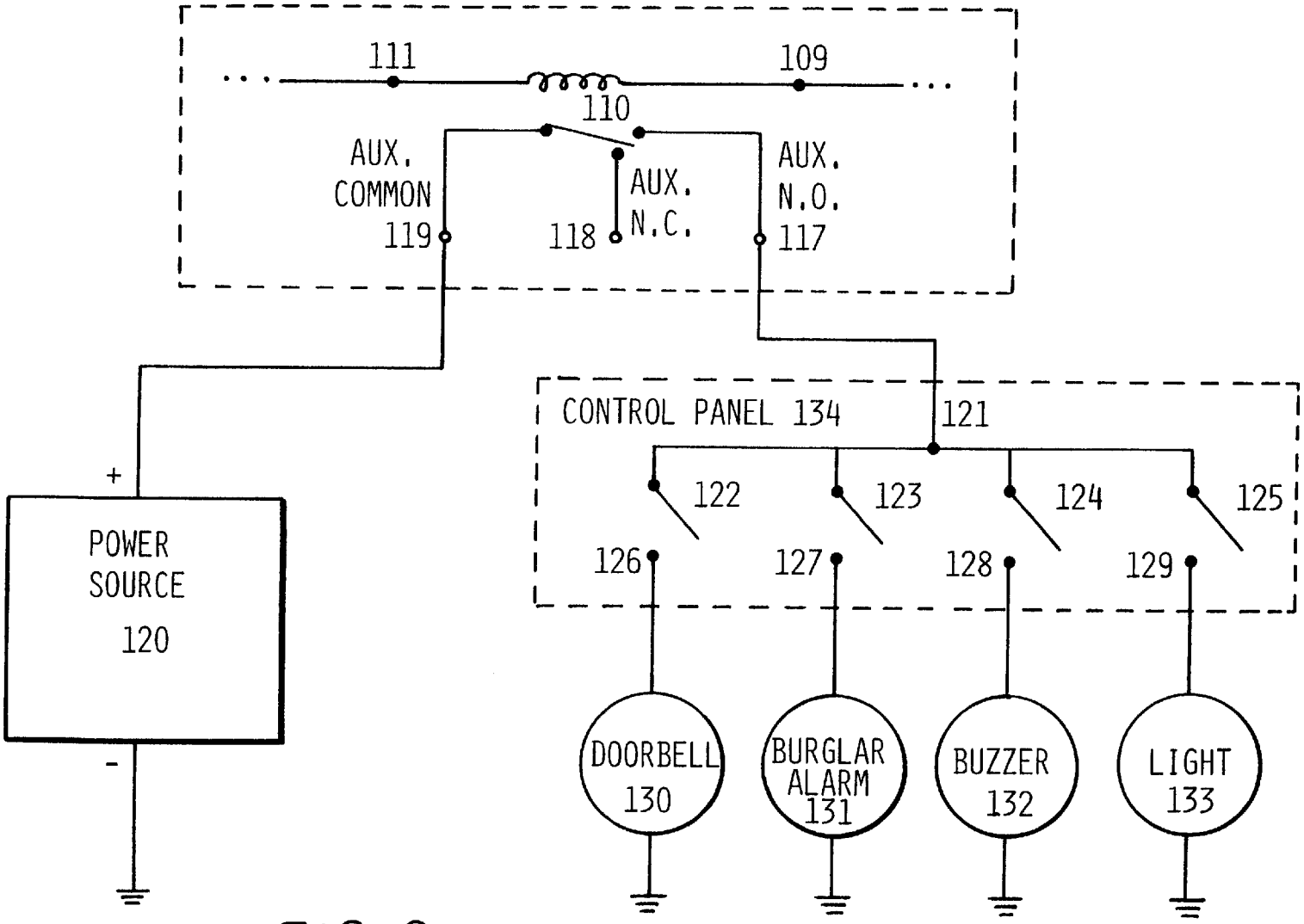
FIG. 2 is a general circuit diagram demonstrating how a central selector switch housing control panel and its alarm selector switches are connected to the main body main body of electronic circuitry in FIG. 1 and various selectable remote alarm indicators.

In FIG. 2, a general circuit diagram demonstrates how a central selector switch housing control panel 134 and its associated alarm selector switches 122, 123, 124, and 125 are connected via nodes 117 and 121 to the main body of electronic circuitry in FIG. 1. In addition, FIG. 2 also demonstrates how alarm selector switches 122, 123, 124, and 125 are connected to various selectable remote alarm indicators, such as doorbell chimes 130 in an existing traditional doorbell system, a burglar alarm indicator 131 in an existing burglar alarm system, an electric buzzer 132, and a light 133, via nodes 126, 127, 128, and 129. Other types of remote alarm indicators may, of course, be utilized as well.

With further regard to FIG. 2, a power source 120 may be connected to node 119 so as to activate the various remote alarm indicators, as dictated by the particular positions of the alarm selector switches, when current passes through the coil of relay 110 and the switch of relay 110 is "pulled in" to thereby short nodes 119 and 117 together. Ideally, power source 120 is also the same general power source applied across primary power terminals 10 and 11 in FIG. 1 and is the same general power source used to activate doorbell chimes 130 and/or burglar alarm indicator 131, including when the doorbell and/or burglar alarm are in their more traditional modes of operation.

Figure 3:
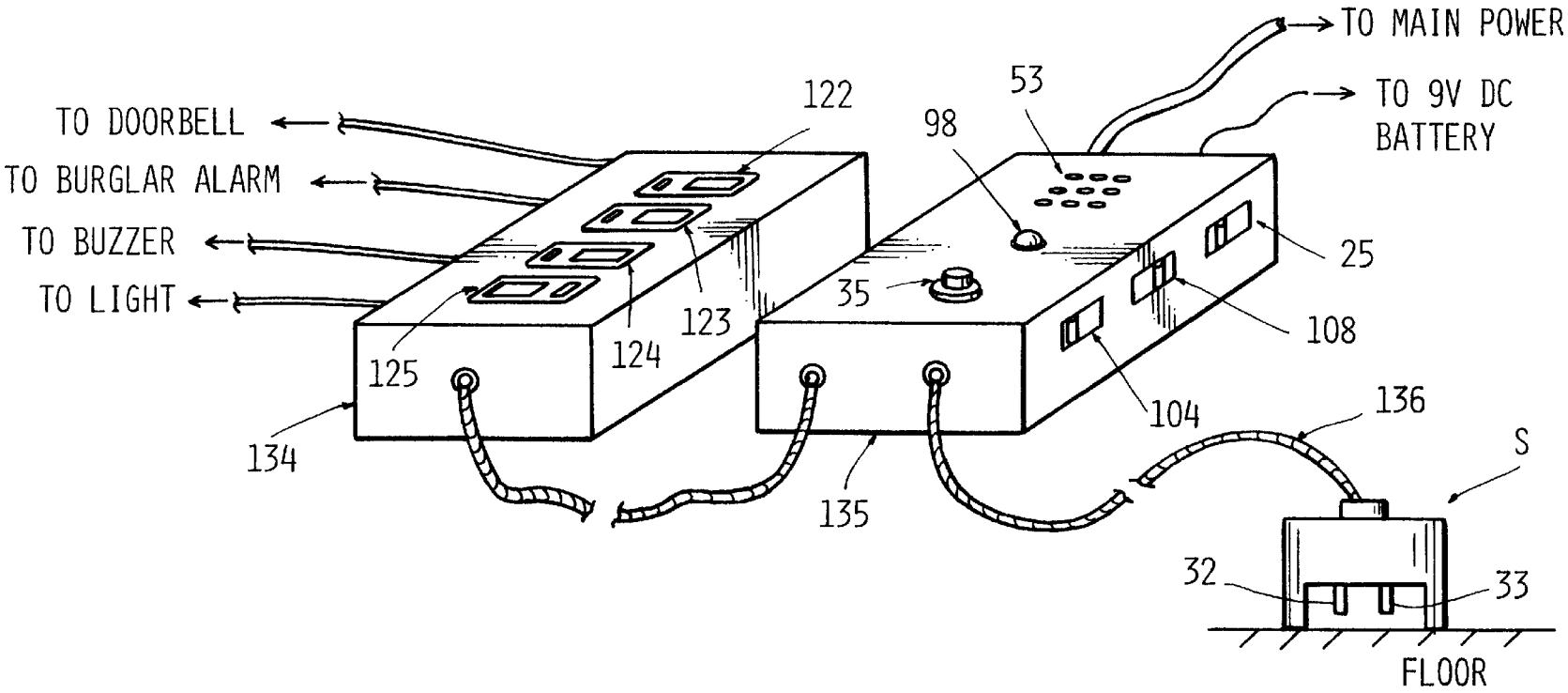
FIG. 3 is a perspective view of the water detection and warning device, including the central selector switch housing control panel, the primary control panel, and the water sensor.

In FIG. 3, an overall perspective view of the water detection and warning device is shown, including its primary control panel 135, connected via coaxial cable 136 to water sensor S (with water "sensing" terminals 32 and 33). FIG. 3 also illustrates how the primary control panel 135 is electrically connected to central selector switch housing control panel 134, wherein alarm selector switches 122, 123, 124, and 125 are mounted. In an alternative embodiment, the primary control panel 135 may instead be linked to the individual alarm selector switches and/or the remote alarm indicators via a wireless remote system.

As shown in FIG. 3 as an example, sensor S (with terminals 32 and 33) may be placed on or near a floor, or other low area, to serve as means for detecting the accumulation of water. Consistent with the present invention, however, other water detecting means may be utilized instead, such as, for example, an optical water sensor or a float/probe water sensor.

In another alternative environment (not shown), sensor S may also be strategically placed in a sump (pit or reservoir) to monitor the fluid level therein. In this way, if sensor S "senses" that the fluid level is undesirably high in the sump, then a sump pump could be activated (in addition to any enabled remote alarm indicators) to remove the excess accumulation of fluid from the sump, as selectively permitted by an additional selector switch.

Figure 4B:
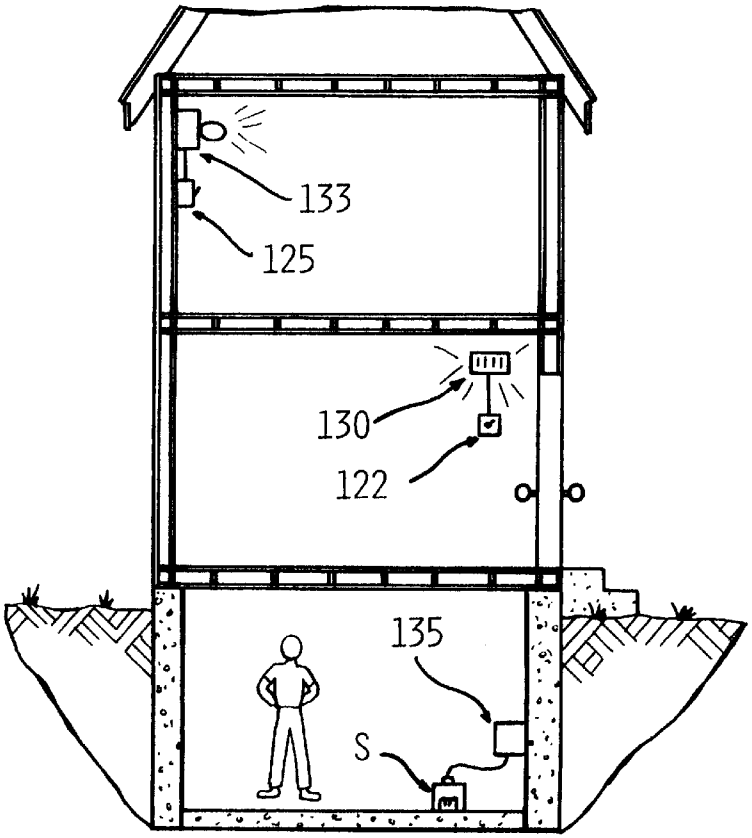
FIG. 4(B) is a cross-sectional view of the water detection and warning device wherein the alarm selector switches and the selectable remote alarm indicators are both positioned in remote locations within a building structure.
Figure 4A:
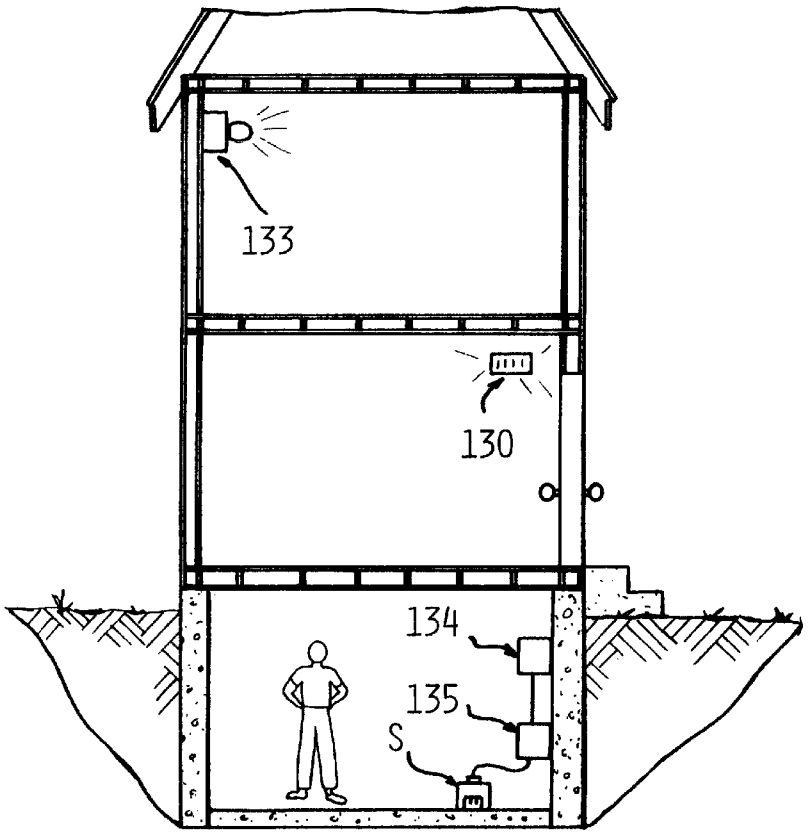
FIG. 4(A) is a cross-sectional view of the water detection and warning device wherein the alarm selector switches are housed in the central selector switch housing control panel and the selectable remote alarm indicators are positioned in different remote locations within a building structure.

As illustrated in FIG. 4(*a*), it is to be understood that, consistent with the present invention, one or more of the various remote alarm indicators may individually be strategically placed at one or more various different locations and/or on one or more various different floors within or outside of a house or building so that the remote alarm indicators are more likely to be within human earshot and/or highly visible when a floodwater and/or water leakage condition occurs. Furthermore, as alternatively illustrated in FIG. 4(*b*), one or more of the various alarm selector switches 122, 123, 124, and 125 may also each be placed at different locations within and/or outside of a house or building instead of being collectively grouped within the central selector switch housing control panel 134.

This concludes the detailed description of the preferred structure of the water detection and warning device. A detailed description of the operation of the water detection and warning device is set forth hereinbelow.

B. Operation of the Invention

In light of the preferred structure set forth above, the main body of electronic circuitry comprising the water detection and warning device, as shown in FIG. 1, operates as follows.

In sub-circuit 1, a power source, preferably a 9 to 24-volt DC or AC battery (or an equivalent 9 to 24-volt DC or AC source obtained via an AC voltage adapter and/or transformer), is connected to primary power terminals 10 and 11. Diodes 13, 15, 17, and 19, along with capacitor 16, are configured such that the potential difference applied across terminals 10 and 11 is transferred to node 18 as a positive voltage potential with respect to electrical ground, regardless of the relative polarities applied to terminals 10 and 11. More particularly, if the anode (positive terminal) of the power source is attached to terminal 10 and the cathode (negative terminal) is attached to terminal 11, current will then flow from the anode into terminal 10, through diode 17, across capacitor 16, and through diode 15. The passage of current through diode 15 in conjunction with node 14 being tied to electrical ground ensures that the voltage potential at node 18, as measured from electrical ground, will be roughly equivalent to the voltage potential difference between the anode and cathode of the power source once capacitor 16 is fully charged. Alternatively, if the power source anode is instead connected to terminal 11 and the power source cathode is connected to terminal 10, current will then flow through diode 19, across capacitor 16, and through diode 13. In either instance, the configuration of diodes 13, 15, 17, and 19, in conjunction with capacitor 16, between terminals 10 and 11 ensures that the voltage potential difference between the anode and cathode of the power source will be transferred to node 18 as measured from electrical ground.

Further in sub-circuit 1, a 9-volt DC battery is connected to backup power terminals 23 and 24 as a backup power source should the primary power source at terminals 10 and 11 fail. Diodes 20 and 22 serve to protect sub-circuit 1 from reverse current situations which could potentially arise due to, for example, mistakenly connecting the anode of the 9-volt backup battery to terminal 24 and the cathode to terminal 23. In addition, diode 22 serves to isolate the 9-volt backup battery when sub-circuit 1 is powered by a primary power source having a greater voltage at terminals 10 and 11, thereby preserving the 9-volt battery until a necessary power backup situation arises.

Power switch 25, as alluded to hereinabove, serves to transfer power to all of the other sub-circuits when in a closed position. In particular, node 26 of sub-circuit 1 provides a power source (AUX+) to sub-circuit 7 whereas node 28 of sub-circuit 1 provides supply voltage B+ to all sub-circuits. Resistor 27 and zener diode 29 (having a preferred breakdown voltage, in this particular exemplary embodiment, of about 12 volts) together comprise a voltage regulator circuit for regulating the supply voltage B+ at node 28. More particularly, resistor 27 provides overcurrent protection in situations where voltage and/or current spikes may emanate from the 12-volt DC source at terminals 10 and 11 or from the 9-volt DC source at terminals 23 and 24. Zener diode 29, on the other hand, according to the exemplary preferred embodiment, has a breakdown voltage of about 12 volts. As a result, if the voltage potential across diode 29 begins to exceed 12 volts, diode 29 will begin to conduct current from node 28 to ground and thereby reduce supply voltage B+ at node 28 until it begins to drop below 12 volts. If supply voltage B+ begins to drop below 12 volts, zener diode 29 will, in essence, stop conducting current so that the voltage at node 28 rises back up to about 12 volts. Such activity by diode 29, in addition to occasional loose primary power or backup battery connections or stray power surges, can cause voltage spikes in the voltage level of supply voltage B+ at node 28. To reduce such spiking, capacitor 31 is connected between node 28 and electrical ground so that the time for charging and/or discharging the voltage potential at node 28 is increased. In this way, spikes in the supply voltage B+ are "filtered out" to ensure steady and uninterrupted power to all other sub-circuits.

Although a total of seven task-specific sub-circuits are set forth in FIG. 1, these seven sub-circuits together are designed to accomplish two primary objectives: 1) detect the presence of water and thereafter activate one or more alarm indicators, and 2) detect a low power situation and thereafter activate one or more alarm indicators. To accomplish these two objectives, when power switch 25 is in a closed position, the electronic circuitry in FIG. 1 generally operates in four different operational states: 1) the state in which no water is detected and a low power situation is not detected; 2) the state in which water is detected and a low power situation is not detected; 3) the state in which no water is detected but a low power situation is detected; and 4) the state in which both water is detected and a low power situation is detected. Circuit implementation of these four operational states is set forth hereinbelow.

State 1—No Floodwater Detected/Power Source OK

In state 1, the absence of floodwater at terminals 32 and 33 in sub-circuit 2 dictates that no current will flow through circuit nodes 39, 34, and 36 due to the open circuit between nodes 34 and 36. As a result, the current flowing through resistor 42 from B+ (derived at node 28 in sub-circuit 1) will all flow into the input of inverting comparator 44. The voltage potential at the input of comparator 44 is, as a result, higher than the set reference voltage of comparator 44 and thereby causes the output voltage of comparator 44 at node 45 to be low.

The resulting low voltage at node 45 dictates that the voltage at node 115 in sub-circuit 7 will be low and that NPN transistor 116 will not allow the passage of current from its collector to emitter. As a result, in state 1, current cannot pass through nodes 107, 109, 111, and 113, even if master remote alarm enabler switch 108 were in a closed position. Thus, the low output voltage at node 45 essentially disables sub-circuit 7.

The resulting low voltage at node 45 also dictates that the voltage at node 59 in sub-circuit 2 will be low and that NPN transistor 60 in sub-circuit 41 as a result, will not permit the passage of current from its collector to emitter. Thus, sound element 53 will not be activated via the combination of transistors 55 and 60 in state 1, for both transistors 55 and 60 must have high voltage potentials at their bases for current to pass through nodes 54, 57, and 62 and thereby activate sound element 53.

Further in state 1, the low voltage at node 45 also dictates that the voltage at node 81 of sub-circuit 5 will be low. Such a low voltage potential at node 81 and at the input of inverting comparator 80 causes the output potential of comparator 80 to be high at node 78. Resistor 77 and zener diode 76 (having a preferred breakdown voltage, in this particular exemplary embodiment, of about 3.6 volts) together comprise a voltage regulator circuit for regulating the resulting voltage potential at node 74 and maintaining the voltage at a high level of about 3.6 volts whenever the output of comparator 80 is high. Capacitor 75 helps to filter the voltage potential at node 74 and thereby maintain a steady voltage level at node 74.

The high voltage potential (approximately 3.6 volts) at the base of PNP transistor 73 in sub-circuit 5 during state 1 ensures that no current will pass from the emitter to the collector of transistor 73. As a result, the high-level current passing through resistor 71 and node 72 from supply voltage B+ (node 28 in sub-circuit 1) will all enter the input of inverting comparator 70 as a high voltage signal. Thus, the resulting output signal of comparator 70 will be low.

Still further in state 1, inverting comparator 89 along with feedback loop elements resistor 83, diode 85, and resistor 86 create, together with capacitor 90, an electrical square wave output signal (an intermittent high signal) at node 87. When the output square wave is high, current is permitted to pass from the collector to emitter in both NPN transistor 56 of sub-circuit 4 and NPN transistor 96 of sub-circuit 6. The passage of current through transistor 96 permits supply voltage B+ to be sampled and current to pass through resistor 94 and light emitting diode (LED) 98 to node 69 in sub-circuit 5. When supply voltage B+ is at or near its proper voltage level, a high-level current will flow into node 69 from node 97 and be added to the low-level current flowing into node 69 from the output of comparator 70 (the output of comparator 70 is low in state 1). The sum of these two currents into node 69 yields a high-level current flowing into the input of inverting comparator 66. Such a high-level input signal produces a low output signal from comparator 66 and a low voltage at the base of NPN resistor 61 in sub-circuit 4. As a result, sound element 53 will not be activated via the combination of transistors 56 and 61 during state 1 when the output square wave signal at node 87 is high, for current will not be permitted to pass from the collector to emitter of transistor 61. When the square wave emanating from comparator 89 instead falls low at node 87, transistor 96 will not permit the passage of current from its collector to emitter, and thus, supply voltage B+ is not sampled. Since the output of comparator 70 is low during state 1, the lack of current passing into node 69 from node 97 dictates that the summed signal input to comparator 66 will be low and that the resulting output of comparator 66 will be high. Thus, current would be permitted to pass from the collector to the emitter of transistor 61 if it were not for the fact that current is not permitted to pass from the collector to the emitter of transistor 56 since the square wave output of comparator 89 is low.

To summarize the effects of state 1, when no water is detected and a low power situation is likewise not detected, sub-circuit 7 is disabled and sound element 53 in sub-circuit 4 is not activated. Since a low power situation is not detected and supply voltage B+ is at a proper voltage level, LED 98 in sub-circuit 6 will merely flash on and off as dictated by the square wave output of comparator 89. Such on-and-off flashing by LED 98 visually indicates to an operator that the power supplied by sub-circuit 1 is at a proper level and is not depleted.

State 2—Floodwater Detected/Power Source OK

In state 2, the presence of water across terminals 32 and 33 and/or the pressing of self-test pushbutton (PB1) 35 shorts circuit nodes 34 and 36 together in sub-circuit 2. As a result, current flowing through resistor 42 from supply voltage B+ is divided at node 43. That is, some of the current flowing into node 43 will flow into the input of inverting comparator 44 while some of the current will be diverted through diode 40 and through nodes 39, 34, 36, and 41. As a result, the voltage potential at the input of comparator 44 is below the set reference voltage of comparator 44, and the yielded output of comparator 44 at node 45 is thus high.

The high voltage potential at node 45 during state 2 dictates that the voltage potential at the base of NPN transistor 60 is high and that current derived from supply voltage B+ will be permitted to flow from the collector to the emitter of transistor 60 only when NPN transistor 55 also permits current to flow from its collector to emitter in sub-circuit 4.

Still further in state 2, inverting comparator 50 in sub-circuit 3 together with feedback loop element resistor 47 and capacitor 49 all create an electrical square wave output signal (an intermittent high signal) at node 51. When the square wave output signal is high, current is permitted to pass from the collector to the emitter of NPN transistor 55 and thereby from the collector to the emitter of NPN transistor 60 (since transistor 60 has a high voltage potential at its base during state 2 as explained previously above). As a result, sound element 53 is automatically activated and an audible alarm noise is produced. Such activation of sound element 53 is a result of current passing from supply voltage B+ (node 28 in sub-circuit 1), through circuit nodes 54, 57, and 62, and to electrical ground as cooperatively permitted by transistors 55 and 60. However, when the square wave output signal produced by comparator 50 is low, transistor 55 alone prevents the passage of current through node 57 and transistor 60. Thus, transistors 55 and 60 do not act cooperatively to activate sound element 53 when the square wave output signal of comparator 50 is low. Thus, when water is detected (or self-test pushbutton PB1 is pressed) in sub-circuit 2 during state 2, sound element 53 will audibly pulsate on and off in synchronization with the square wave output signal of comparator 50. The frequency of the pulsation of sound element 53 during a floodwater (or test) situation will be dictated primarily by the capacitance of capacitor 49.

The high voltage potential at node 45 during state 2 dictates that sub-circuit 7 will be enabled by the resulting high voltage at the base of NPN transistor 116. As a result, if master remote alarm enabler switch 108 is set to a closed position, current can be successfully drawn from AUX+ (derived at node 26 in sub-circuit 1) and through relay 110, node 111, and node 113 when the voltage potential at the base of NPN transistor 112 is high. When current passes through the coil of relay 110, the switch of relay 110 is pulled in so that nodes 117 and 119 are shorted together, thereby activating other external auxiliary devices (that is, remote alarm indicators 130, 131, 132, and 133 as dictated by the positions of alarm selector switches 122, 123, 124, and 125) that a floodwater and/or water leakage (or self-test) situation has arisen.

It should be noted that during a detected flood (or test) situation when master remote alarm enabler switch 108 is closed, the particular position of alarm signal selector switch 104 will dictate whether a continuous high signal will be transmitted to the external auxiliary devices (remote alarm indicators 130, 131, 132, and 133) which are selectively enabled and thereby connected to node 117, or whether an intermittent high signal will instead be transmitted. More particularly, if alarm signal selector switch 104 is positioned such that nodes 103 and 105 are shorted together, then a continuous high signal from supply voltage B+ will be applied to the base of NPN transistor 112 and current will thereby be permitted to pass continuously through the coil of relay 110 to ensure that an uninterrupted signal will pass from node 119 to node 117. In this way, for example, light 133 in FIG. 2 will signify a floodwater condition by being continuously illuminated if alarm selector switch 125 is in a closed position. If, on the other hand, alarm signal selector switch 104 is instead positioned such that nodes 102 and 105 are shorted together, the intermittent high signal (square wave output signal) derived in sub-circuit 2 will then be applied to the base of transistor 112. As a result, current through the coil of relay 110 will be successively turned on and off, thereby successively toggling the switch of relay 110 between node 117 (normally open) and node 118 (normally closed) and creating an intermittent high signal at node 117. In this way, if selector switch 125 in FIG. 2 is in a closed position, then light 133 will flash on and off to signify a floodwater and/or water leakage situation.

The high voltage potential at node 45 during a floodwater (or test) situation during state 2 further dictates that the voltage potential at the input of inverting comparator 80 in sub-circuit 5 is high as well. Thus, the resulting voltage output of comparator 80 is low and the voltage potential at the base of PNP transistor 73 at node 74 is likewise low. Given that transistor 73 is of the PNP type, the low voltage potential at its base permits the flow of current from its emitter to collector. As a result, the current flowing from supply voltage B+ and through resistor 71 is divided at node 72, thereby directing a reduced low-level current into inverting comparator 70. Such a low input dictates that inverting comparator 70 has a high output current entering node 69. The presence of such a high signal at node 69 due solely to the output of comparator 70 essentially negates the practical effect of any current that may be flowing into node 69 from sub-circuit 6, for the high signal at node 69 produced by comparator 70 is alone sufficiently above the reference voltage of inverting comparator 66 and thus a low signal is produced at the output of comparator 66 at node 65. The resulting low voltage potential at node 65 prevents the passage of any current from the collector to the emitter of NPN transistor 61 in sub-circuit 4. Thus, in state 2, sound element 53 is always activated solely by the enabling combination of transistors 55 and 60, not by the combination of transistors 56 and 61.

To summarize the effects of state 2, when a floodwater (or test) situation is detected in sub-circuit 2 and a low power situation is not detected, sound element 53 will pulsate on and off in synchronization with the square wave output signal produced by comparator 50 in sub-circuit 3. In addition, sub-circuit 7 is enabled via transistor 116 and can be selectively activated by closing master remote alarm enabler switch 108. When switch 108 is in a closed position, a continuous high signal or intermittent high signal is sent to the remote alarm indicators which are connected to node 117

(as dictated by the positions of the alarm selector switches). The position of alarm signal selector switch 104 dictates whether the signal sent to the connected remote alarm indicators is a continuous high signal or an intermittent high signal. Also, LED 98 in sub-circuit 6 will continue to flash on and off, as dictated by the square wave output signal of comparator 89 in sub-circuit 6, thereby indicating that supply voltage B+ is at a proper voltage level.

State 3—No Floodwater Detected/Power Source Low

In state 3, the absence of floodwater dictates (as described in detail earlier concerning state 1) that sub-circuit 7 will essentially be disabled due to the low voltage potential both at node 45 and at the base of NPN transistor 116. In addition, the low voltage potential at node 45 dictates that current will not be permitted to flow from the collector to the emitter of NPN transistor 60 in sub-circuit 4 and that sound element 53 thus will not be activated via the cooperation of transistors 55 and 60 in sub-circuit 4.

However, the low current signal at the output of comparator 70, due to the lack of a floodwater (or self-test) situation sensed by sub-circuit 2 (as described in detail earlier concerning state 1), will remain low at node 69 when combined with the weak current derived from a waning supply voltage B+ sampled from sub-circuit 6. Thus, when the square wave output signal (intermittent high signal) produced by comparator 89 is high, transistor 96 permits supply voltage B+ in sub-circuit 6 to be sampled at node 69 in sub-circuit 5. The low-level current entering node 69 from the sampling of a problematically low supply voltage B+ via transistor 96 is not high enough, once B+ falls below a certain voltage level, to combine with the low-level current flowing from the output of comparator 70 and produce a signal at the input of comparator 66 which is higher than the reference voltage of comparator 66. As a result, the output of comparator 66 will remain continuously high, both when supply voltage B+ in sub-circuit 6 is sampled and when it is not sampled. Thus, in state 3, transistor 61 will continuously permit any current derived from supply voltage B+ in sub-circuit 4 to pass from its collector to emitter when cooperatively permitted by transistor 56. Due to the intermittent high signal (square wave output signal) produced by comparator 89 in sub-circuit 6, NPN transistor 56 in sub-circuit 4 alternatingly permits current to pass from its collector to emitter. More particularly, when the square wave output signal produced in sub-circuit 6 is high, current derived from B+ in sub-circuit 4 is cooperatively permitted to pass through NPN transistor 56 and transistor 61 (since transistor 61 has a continuously high voltage potential at its base during state 3 as explained above). As a result, sound element 53 is activated and an audible alarm is produced.

In state 3, such activation of sound element 53 in sub-circuit 4 is a result of current passing from supply voltage B+ and through circuit nodes 54, 58, and 62 as cooperatively permitted by transistors 56 and 61. However, when the square wave output signal produced by comparator 89 is low, transistor 56 is not activated and thereby alone prevents the passage of current derived from B+ through the collector and emitter of transistor 61. As a result, transistors 56 and 61 do not activate sound element 53 when the square wave output signal is low. Thus, when floodwater is not detected in sub-circuit 2, but a low power condition is detected in sub-circuit 5, sound element 53 will pulsate on and off in synchronization with the square wave output signal produced by comparator 89. The frequency of the pulsation of sound element 53 during a low power condition will be dictated primarily by the capacitance of capacitor 90 and the particular feedback loop configuration of comparator 89.

To summarize the effects of state 3, when no water is detected and a low power situation is detected, sub-circuit 7 is disabled and sound element 53 in sub-circuit 4 is activated via the cooperation of transistors 56 and 61. Due to differences in capacitances and feedback loop configurations surrounding the comparators in sub-circuits 3 and 6, the square waves produced by these two sub-circuits are different. As a result, two different audible alarm noises can emanate from sound element 53: a first alarm noise emitted during floodwater or self-test situations (state 2), and a second alarm noise emitted during low power situations (state 3). Thus, the particular alarm noise emitted during state 3 will be discernably different to a human listener from the alarm noise emitted during state 2. Furthermore, in state 3, as long as the power supplied by sub-circuit 1 is not completely depleted, LED 98 in sub-circuit 6 will generally flash on and off as dictated by the square wave output signal produced by comparator 89 even though supply voltage B+ is waning and has dropped below its preferred voltage level. If the low power situation is not timely remedied, however, the power supplied by sub-circuit 1 may eventually be depleted. If such occurs, both sound element 53 and LED 98 will no longer be activated.

State 4—Floodwater Detected/Power Source Low

In state 4, both floodwater and low power conditions are detected. However, with regard to activation of the various automatic and selectable remote alarm indicators to indicate such co-existing conditions, the resulting effect of state 4 is exactly the same as state 2 (alarm indicators indicate that floodwater is detected but a low power condition is not detected). That is, instead of simultaneously attempting to automatically activate sound element 53 for both floodwater detection (via cooperation of transistors 55 and 60) and low-power detection (via cooperation of transistors 56 and 61), sub-circuit 5 essentially overrides and ignores the detection of a low power situation and instead chooses to merely permit sub-circuits 2 and 3 to activate sound element 53 to solely indicate the detection of water along with any of the enabled remote alarm indicators 130, 131, 132, and 133 in FIG. 2. Thus, by design, a floodwater situation is deemed more urgent and worthy of alarm than a low power situation.

More particularly, as in state 2, the output of inverting comparator 70 in sub-circuit 5 during state 4 is high. As a result, when supply voltage B+ is sampled in sub-circuit 6, the current passed down through nodes 95 and 97 to node 69 in sub-circuit 5 is low and does not substantially affect the resulting combined signal entering inverting comparator 66. That is, regardless of the strength or the weakness of the signal entering node 69 from sub-circuit 6, the fact that the output of comparator 70 is high alone dictates that the input to inverting comparator 66 will be high and that the output of comparator 66 will be low. As a result, transistor 61 of sub-circuit 4 will not permit the passage of current from its collector to emitter due to the low voltage potential at its base. Thus, in state 4, sound element 53 will only be activated by the cooperative combination of transistors 55 and 60 (signifying a flood condition) and will not be activated by the combination of transistors 56 and 61 (the combination of which typically signifies a low battery situation) even though there is actually a low power situation in state 4. Again, in essence, sub-circuit 5 during state 4 overrides any indication of a low power situation and instead chooses to only acknowledge the detected floodwater situation.

This concludes the detailed description of the operation of the water detection and warning device.

While the present invention has been described in what is presently considered to be the most practical and preferred embodiment, it is to be understood that the invention is not to be limited to the disclosed embodiment but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A device for detecting and warning of water about a building structure, said device comprising:

a plurality of selectable alarm indicators;

a plurality of alarm selector switches, each one alarm selector switch electrically connected to one alarm indicator;

means for detecting the presence of water, said water detecting means electrically connected to said plurality of alarm selector switches; and a power circuit electrically connected to said water detecting means.

2. The device according to claim 1, wherein said selectable alarm indicators are positioned at distinct locations remote from said water detecting means such that said alarm selector switches are capable of enabling said selectable alarm indicators at said distinct locations.

3. The device according to claim 1, wherein said plurality of selectable alarm indicators includes at least one visual alarm indicator.

4. The device according to claim 1, wherein said plurality of selectable alarm indicators includes at least one audio alarm indicator.

5. The device according to claim 1, wherein said plurality of selectable alarm indicators includes at least one visual alarm indicator and at least one audio alarm indicator.

6. The device according to claim 1, wherein said plurality of selectable alarm indicators includes at least one of a doorbell system and a burglar alarm system.

7. The device according to claim 1, said device further comprising:

an intermittent signal generator circuit electrically connected to said power circuit; and an alarm signal selector switch electrically connected between said intermittent signal generator circuit and said plurality of alarm selector switches.

8. The device according to claim 1, said device further comprising a master alarm enabler switch electrically connected between said power circuit and said plurality of alarm selector switches, said master alarm enabler switch enabling all of said plurality of selectable alarm indicators as permitted by said plurality of alarm selector switches.

9. The device according to claim 1, said device further comprising a central selector switch housing wherein said plurality of alarm selector switches are commonly mounted.

10. The device according to claim 1, wherein said alarm selector switches are remotely positioned at different locations away from said water detecting means such that said alarm selector switches are capable of being activated at said different locations.

11. The device according to claim 1, said device further comprising an audio alarm indicator electrically connected to said water detecting means and to said power circuit, said audio alarm indicator capable of being automatically activated to emit a first alarm noise whenever said water detecting means detects a floodwater condition.

12. The device according to claim 11, wherein said water detecting means includes a selectively activatable self-test circuit electrically connected to said audio alarm indicator, said audio alarm indicator capable of being automatically activated to emit said first alarm noise whenever said self-test circuit is selectively activated.

13. The device according to claim 11, said device further comprising a low power detection circuit electrically connected to said power circuit and to said audio alarm indicator, said audio alarm indicator capable of being automatically activated to emit a second alarm noise whenever said low power detection circuit detects a low power condition in said power circuit.

14. The device according to claim 13, wherein said low power detection circuit comprises an override circuit which ignores detection of said low power condition whenever said floodwater condition and said low power condition occur simultaneously so that said audio alarm indicator is automatically activated to emit said first alarm noise.

15. The device according to claim 13, wherein said power circuit is capable of being electrically connected to at least one electrical power source, and wherein said low power detection circuit includes a light indicator capable of indicating whether said power circuit is electrically connected to said at least one electrical power source.

16. The device according to claim 1, wherein said power circuit comprises:

a voltage regulator circuit;

primary power terminals electrically connected to said voltage regulator circuit, said primary power terminals capable of being electrically connected to an electrical power source; and backup power terminals electrically connected to said voltage regulator circuit, said backup power terminals capable of being electrically connected to a direct-current battery.

17. A device for detecting and warning of water about a building structure, said device comprising:

a plurality of selectable remote alarm indicators;

a plurality of alarm selector switches wherein each alarm selector switch of said plurality of alarm selector switches is electrically connected to a particular remote alarm indicator of said plurality of selectable remote alarm indicators;

a power circuit; and means for detecting the presence of water, said water detecting means electrically connected to said power circuit and to said plurality of alarm selector switches, wherein said selectable remote alarm indicators are remotely positioned at different locations away from said water detecting means such that said alarm selector switches are capable of selectively enabling said selectable remote alarm indicators at said different locations about said building structure.

18. The device according to claim 17, said device further comprising a central selector switch housing wherein said plurality of alarm selector switches are commonly mounted to provide user access to each of said plurality of alarm selector switches simultaneously.

19. The device according to claim 17, wherein said alarm selector switches are remotely positioned along with said selectable remote alarm indicators at said different locations away from said water detecting means such that said alarm selector switches are capable of being activated at said different locations about said building structure.

20. A device for detecting and warning of water about a building structure, said device comprising:

a plurality of selectable remote alarm indicators;

a plurality of alarm selector switches wherein each alarm selector switch of said plurality of alarm selector switches is electrically connected to a particular remote alarm indicator of said plurality of selectable remote alarm indicators;

a power circuit capable of being electrically connected to an electrical power source;

means for detecting the presence of water, said water detecting means electrically connected to said power circuit and to said plurality of alarm selector switches;

an audio alarm indicator electrically connected to said water detecting means and to said power circuit, said audio alarm indicator capable of being automatically activated to emit a first alarm noise whenever said water detecting means detects a floodwater condition; and a low power detection circuit electrically connected to said power circuit and to said audio alarm indicator, said audio alarm indicator capable of being automatically activated to emit a second alarm noise whenever said low power detection circuit detects a low power condition in said power circuit, wherein said low power detection circuit comprises an override circuit which ignores detection of said low power condition whenever said floodwater condition and said low power condition occur simultaneously so that said audio alarm indicator is automatically activated to emit said first alarm noise.

* * * * *